US005311168A

United States Patent [19]

Pease, Jr. et al.

[11] Patent Number: 5,311,168

[45] Date of Patent: May 10, 1994

[54] LOCK SET WITH SELF-CONTAINED DOOR ALARM AND ANNUNCIATOR SYSTEM

[75] Inventors: David H. Pease, Jr., Cincinnati, Ohio; William W. Kling, Florence, Ky.

[73] Assignee: Pease Industries, Inc., Fairfield, Ohio

[21] Appl. No.: 942,987

[22] Filed: Sep. 10, 1992

[51] Int. Cl.[5] ..... G08B 13/06; G08B 13/08

[52] U.S. Cl. ..... 340/542; 70/DIG. 49; 200/61.93

[58] Field of Search ..... 340/542; 200/61.93; 70/441, 439, 432, DIG. 49, DIG. 51

[56] References Cited

U.S. PATENT DOCUMENTS

| | | | |
|---|---|---|---|
| 908,813 | 1/1909 | Stevens | 70/283 |
| 963,301 | 7/1910 | Leppert | 200/531 |
| 1,082,667 | 12/1913 | Williams et al. | 340/527 |
| 1,097,884 | 5/1914 | Sheinman | 200/61.64 |
| 1,160,496 | 11/1915 | Casper | 340/542 |
| 1,389,499 | 8/1921 | Gerlach | 70/287 |
| 1,674,570 | 6/1928 | Re | 200/61.67 |
| 1,738,243 | 12/1929 | Hedberg | 340/546 |
| 1,990,327 | 2/1935 | Jacobson | 70/441 |
| 2,011,944 | 8/1935 | Lodispoto | 200/61.66 |
| 2,170,521 | 8/1939 | Rodth | 340/542 |
| 2,286,463 | 6/1942 | Chaskin | 340/568 |
| 2,287,572 | 6/1942 | Rodth | 340/542 |
| 2,295,482 | 9/1942 | Kemp | 340/542 |
| 2,393,014 | 1/1946 | Bartholy | 361/199 |
| 2,436,470 | 2/1948 | Fleming | 340/527 |
| 2,437,777 | 3/1948 | Zajc | 340/545 |
| 2,615,083 | 10/1952 | Krueger | 340/542 |
| 2,617,868 | 11/1952 | Menkin | 340/545 |
| 2,634,409 | 4/1953 | Walcher | 340/545 |
| 2,756,300 | 7/1956 | Thiberville | 200/61.67 |
| 2,818,475 | 12/1957 | Harry | 200/61.64 |
| 2,838,747 | 6/1958 | Jezl | 340/542 |
| 2,838,748 | 6/1958 | Torma | 340/542 |
| 2,874,240 | 2/1959 | Ricks | 200/61.85 |
| 3,002,187 | 9/1961 | Spear | 340/328 |
| 3,042,910 | 7/1962 | Shull | 340/522 |
| 3,134,970 | 5/1964 | Kelly et al. | 340/515 |
| 3,158,850 | 11/1964 | Poznanski | 340/529 |
| 3,168,730 | 2/1965 | Baldinelli | 340/392 |
| 3,192,517 | 6/1965 | Werlin | 340/546 |
| 3,196,293 | 7/1965 | Howard | 307/114 |
| 3,259,707 | 7/1966 | Eickhoff, III | 200/61.67 |
| 3,353,383 | 11/1967 | Fish | 70/151 R |
| 3,402,405 | 9/1968 | Contreras | 340/542 |
| 3,432,631 | 3/1969 | Deutscher et al. | 200/61.67 |
| 3,525,830 | 8/1970 | Hawkins | 340/542 |
| 3,530,262 | 9/1970 | Hawkins | 200/43.08 |
| 3,587,080 | 6/1971 | Hawkins | 340/542 |
| 3,587,081 | 6/1971 | Hawkins et al. | 340/529 |
| 3,605,087 | 9/1971 | Nine | 340/430 |
| 3,614,734 | 10/1971 | Davis | 340/428 |
| 3,623,062 | 11/1971 | Hawkins | 340/542 |
| 3,643,249 | 2/1972 | Haywood | 340/542 |
| 3,653,022 | 3/1972 | Tall | 340/545 |
| 3,660,831 | 5/1972 | Nicola et al. | 340/542 |
| 3,665,259 | 5/1972 | Brailsford | 361/208 |
| 3,683,346 | 8/1972 | Horton | 340/528 |
| 3,693,110 | 9/1972 | Briggs, Jr. et al. | 331/47 |
| 3,696,374 | 10/1972 | Vosbikian et al. | 340/528 |
| 3,714,643 | 1/1973 | Sosin et al. | 340/542 |
| 3,810,145 | 5/1974 | Gusaras | 340/542 |
| 3,828,340 | 8/1974 | Bauer, Jr. et al. | 340/542 |
| 3,833,899 | 9/1974 | Blosse | 340/542 |
| 3,866,164 | 2/1975 | Peterson | 340/522 |
| 3,866,203 | 2/1975 | Berns | 340/542 |
| 3,936,673 | 2/1976 | Kelly et al. | 307/10.3 |
| 3,939,315 | 2/1976 | Schlage | 200/61.64 |
| 4,006,471 | 2/1977 | Pappas | 340/542 |
| 4,012,611 | 3/1977 | Petersen | 200/61.45 R |

(List continued on next page.)

FOREIGN PATENT DOCUMENTS

| | | |
|---|---|---|
| 954213 | 9/1974 | Canada . |
| 2320405 | 3/1977 | France . |

OTHER PUBLICATIONS

Excluder Plus Door Alarm Brochure (two pages).

*Primary Examiner*—Glen R. Swann, III

*Attorney, Agent, or Firm*—Wood, Herron & Evans

[57] ABSTRACT

A self-contained alarm/annunciator system for a door provides an alarm function and a flashing LED when the door is locked to deter attempted burglary, and an annunciator function operable when the door is unlocked to indicate attempted door opening.

19 Claims, 3 Drawing Sheets

U.S. PATENT DOCUMENTS

| | | | |
|---|---|---|---|
| 4,035,791 | 7/1977 | Katayama | 340/522 |
| 4,122,437 | 10/1978 | Petersen | 340/528 |
| 4,129,865 | 12/1978 | Randall | 340/542 |
| 4,196,422 | 4/1980 | Swigert et al. | 340/542 |
| 4,227,188 | 10/1980 | Petersen | 340/566 |
| 4,247,847 | 1/1981 | Gontowski, Jr. | 340/566 |
| 4,258,358 | 3/1981 | Lee et al. | 340/543 |
| 4,282,518 | 8/1981 | Bonner | 340/566 |
| 4,333,093 | 6/1982 | Raber et al. | 340/566 |
| 4,360,803 | 11/1982 | Heiland | 340/552 |
| 4,370,644 | 1/1983 | Droz | 340/528 |
| 4,381,504 | 4/1983 | Bitko | 340/689 |
| 4,465,997 | 8/1984 | Hines | 340/542 |
| 4,575,713 | 3/1986 | Piper | 340/546 |
| 4,587,517 | 5/1986 | Engstrom et al. | 340/542 |
| 4,683,741 | 8/1987 | Fields | 70/441 |
| 4,760,380 | 7/1988 | Quenneville et al. | 340/542 |
| 4,833,454 | 5/1989 | Pawlik et al. | 340/545 |
| 4,845,471 | 7/1989 | Chu | 340/542 |
| 4,912,456 | 3/1990 | Mickel | 340/542 |
| 5,208,579 | 5/1993 | Tseng | 340/542 |

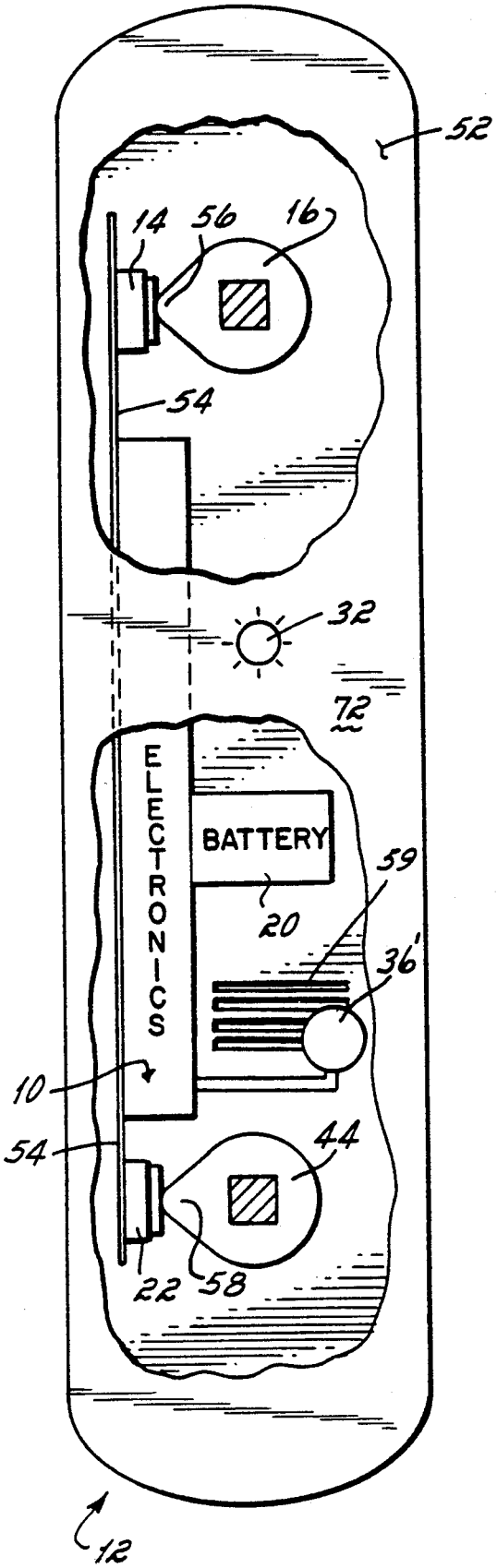
FIG. 2
FIG. 3
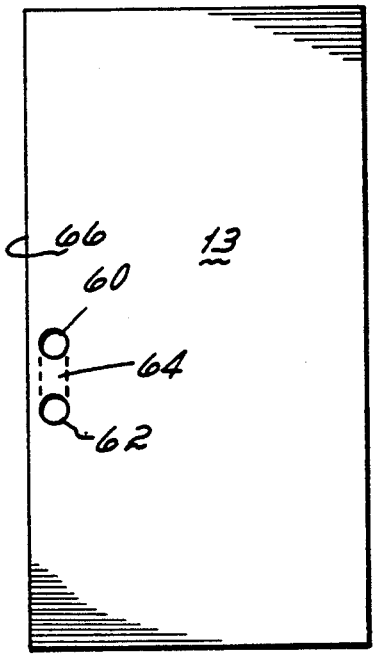
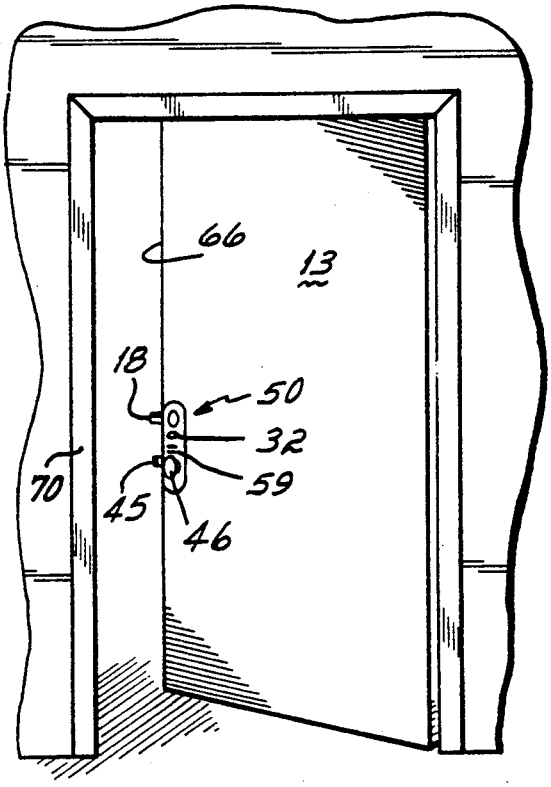
FIG. 4

LOCK SET WITH SELF-CONTAINED DOOR ALARM AND ANNUNCIATOR SYSTEM

BACKGROUND OF THE INVENTION

1. Field of the Invention

The present invention relates to door mounted alarm systems, and more particularly to a lock set with a self-contained alarm/annunciator system such as for use in a door and operable without external wiring or extensive modification to the door frame.

2. Description of the Prior Art

The ever increasing number of residential burglaries in recent years has intensified the need for alarm systems. Typical residential alarm systems may include a plurality of sensor mechanisms at various entrance points connected by external wiring to an indicator panel or some other control panel, and may further include a communication link for alerting law enforcement authorities to a break-in. Unfortunately, while such alarm systems may provide a number of desirable features, they are often expensive, and in the case of a retrofit system, may require extensive external wiring and modification to the dwelling such as to the frame surrounding the door.

Today, as many as 85–90 percent of all residential burglaries are perpetrated by nonprofessional burglars who are oftentimes easily scared off. While expensive and complicated alarm systems which require extensive external wiring and door frame modification may provide a wide range of deterrence features, their cost and complexity may not be necessary to deter a majority of the residential burglaries. For example, an alarm system which merely creates a loud alarm sound upon an attempted unauthorized entry may often deter the would-be residential burglar. Therefore, deterrence ability becomes an important focus of residential alarm systems.

It has been proposed to provide a limited function, self-contained alarm unit for application to a door, for example, wherein the self-contained system includes arming circuitry, alarm sensor, and alarm sounding system all in a single housing. Some of these door mounted alarm systems may also integrate a door locking mechanism such that the alarm unit is armed when the door is locked and disarmed otherwise. However, such self-contained lock and alarm systems can be of limited utility and may not provide a desirable range of deterrence features.

SUMMARY OF THE INVENTION

The present invention provides an enhanced lock and alarm system which is easy to apply and use, but which contains a desirable range of burglar deterrent features. The system is operable without the complexity or dwelling modifications typically found in or required of prior, full-featured units. To this end, and in accordance with one aspect of the present invention, a lock and alarm system includes, in addition to an alarm function when the door is locked, an annunciator feature operable when the door is unlocked to provide an indication to those in the house, as well as to those entering the house, that the door is being opened. In this way, although the door is unlocked and the loud sounding alarm system disabled, warning is still given to alert residents and ward off would be burglars to thereby still provide a burglar deterrent feature. When the door is locked, the alarm system takes over and the annunciator system is disabled. Thereafter, motion of the door, for example, causes the system to emit a loud alarm sound, indicating an unauthorized entry or attempted entry.

Preferably, the lock and alarm system of the present invention includes a dead-bolt both for locking and unlocking the door as well as for controlling the alarm function such that the alarm function is enabled (the system armed) and disabled (or disarmed) by the dead-bolt mechanism. More specifically, throwing the dead-bolt to lock the door arms the alarm system so that vibration of the door (such as would be caused by an attempt to force open the door) sets off the alarm sequence. Withdrawing the dead-bolt to unlock the door disables the alarm function and enables the annunciator function so that an annunciator signal is provided whenever the door is opened.

Preferably, the annunciator is a chiming sound which announces to an occupant of the house that someone is entering the premises, and which may further serve as an audible deterrent to an intruder seeking to quietly slip into the house unnoticed through an unlocked door. The alarm and annunciator functions may be mutually exclusive so that only one or the other function is enabled at a time. Where the lock-set is two-part and thus also includes a door latch or knob for opening the unlocked door, the annunciator may be made responsive to operation of the door latch or knob.

As an additional feature of the present invention, added deterrence to would-be burglars is provided by energizing a flashing light visible from outside the door when the alarm system is enabled. The flashing light tends to draw the would-be burglar's attention to the presence of an alarm system, thus providing a visible deterrent. The light also provides an indication to the homeowner that the battery may need to be replaced if, for example, the light does not turn on when the door is locked.

The above features are preferably incorporated into the same housing containing the lock-set such as a dead-bolt only, or a two part lock set such as a multi-point lock set, a tubular dead bolt and latch mechanism, or a mortise lock set. The single construction allows the door lock alarm to be placed in a door without external wiring and with little or no modification of the door frame. This simplicity is achieved all while providing a self-contained alarm system with desired important deterrent abilities.

The above and other objects and advantages of the present invention will become apparent with reference to the drawings and detailed description of various embodiments of the invention which follows.

BRIEF DESCRIPTION OF THE DRAWINGS

In the accompanying drawings, which are incorporated in and constitute a part of this specification, embodiments of the invention are illustrated which, together with a general description of the invention given above, and the detailed description of the embodiments given below, serve to explain the principles of the invention.

FIG. 2 is a simplified diagrammatic view showing the alarm/annunciator of FIG. 1 in a self-contained two-part lock set;

FIG. 3 is a plan view of a typical door;

FIG. 4 is a perspective view of an open door and door frame showing the self-contained alarm/annunciator system of FIGS. 1 and 2 installed therein;

DETAILED DESCRIPTION OF THE DRAWINGS

Figure 1:
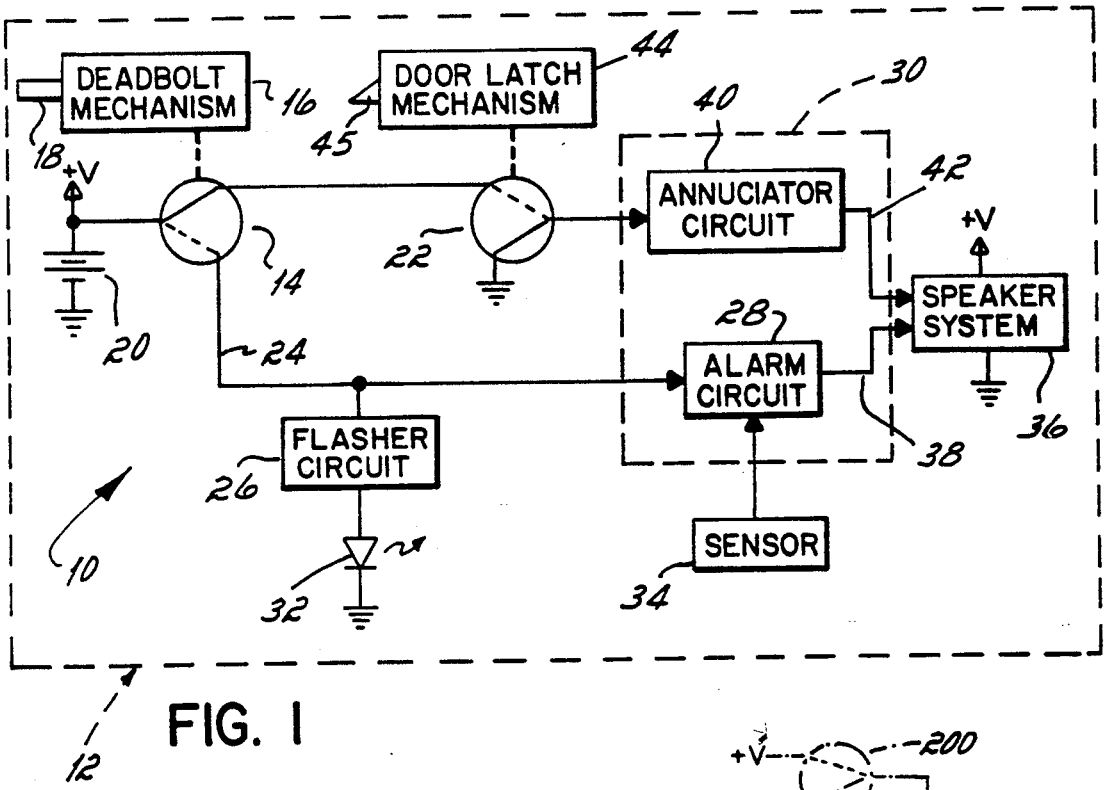
FIG. 1 is an electrical circuit block diagram of a two-part lock set embodiment of an alarm/annunciator system in accordance with the principles of the present invention.

With reference to FIG. 1 there is shown a first embodiment of a door alarm/annunciator system 10 in accordance with the principles of the present invention. System 10 is contained within a two-part lock set 12 to be mounted to a door 13 (see FIGS. 2 and 4). In system 10, first switch 14 is coupled to the dead-bolt mechanism 16 of lock set 12 and is in a first position shown in solid line in FIG. 1 when dead-bolt 18 is withdrawn to unlock door 13 (see FIG. 4), and in a second position shown in dashed line in FIG. 1 when dead-bolt mechanism 16 is actuated to extend dead-bolt 18 such as to lock door 13. In the first position of switch 14 (door unlocked), a power source, such as battery 20, is coupled to second switch 22 for the annunciator function as will be described. In the second (door locked) position of switch 14, battery 20 is disconnected from switch 22 and is instead connected to line 24 to provide an alarm enable signal which energizes a flasher circuit 26 and energizes alarm circuit 28, thereby placing electric circuit 30 in the alarm mode such that system 10 is armed. When system 10 is armed, flasher circuit 26 causes light source 32 (such as a red light-emitting-diode or LED) mounted to be seen from the outside of door 13 as seen in FIG. 4 to flash on and off such as at a one (1) Hz rate Which may deter a would-be burglar who sees the flashing light. Additionally, when switch 14 is in the locked position, failure of LED 32 to light is indicative that battery 20 may need to be replaced.

When electric circuit 30 is in the alarm mode, alarm circuit 28 thereof responds to signals (alarm state signals) from sensor 34 resulting from motion or vibration of door 13 to which sensor 34 is coupled. To this end, sensor 34 may be a piezoelectric vibration sensor and associated circuitry as is utilized in the Excluder Plus door alarm available from Security-style, Ltd. in England. In response to an alarm state signal from sensor 34, alarm circuit 28 will generate an audio frequency alarm-on signal which is coupled to speaker system 36 over line 38, thereby causing an alarm to sound and alerting those in the vicinity of a possible break-in while possibly scaring off a would-be burglar. Speaker system 36 may include an amplifier (not shown) and piezoelectric disc speaker 36' (see FIG. 2) in a plastic acoustic amplifying housing as is conventional. To this end, speaker 36' and the associated plastic housing may be as provided in The Defender window alarm available from European Safety Products (Canada) Ltd. in Ontario, Canada, or the aforementioned Excluder Plus door alarm. The audible alarm of such devices is about 130 db which is so loud as to alert others in the vicinity and to immediately scare off the would-be burglar. Preferably, as in the case of the Excluder Plus and the Defender products, the audio frequency alarm-on signal varies over a plurality of frequencies by stepping up and down through the frequencies.

When switch 14 is in the unlocked position (solid line), flasher circuit 26 and alarm circuit 28 are de-energized, thereby disabling the alarm function of system 10. Electric circuit 30 is now in the annunciator mode in which activation of switch 22 from its normally open position (solid line) to its closed position (dashed line) temporarily couples power from battery 20 (i.e., a door-open signal is provided) to annunciator circuit 40 of electric circuit 30. In response to the door-open signal, annunciator circuit 40 generates an audio frequency annunciator-on signal which is coupled to speaker system 36 over line 42 to cause an annunciator sound, such as a chime sound or a bing-bong sound, to be emitted. Switch 22 is preferably coupled to a door latch mechanism 44 having a latch 45 and being operable by door knob 46 (see FIG. 4), so that an attempt to open the unlocked door 13 by manipulation of the door knob 46 of latch mechanism 44 results in an annunciator sound from speaker system 36. In this way, not only are those nearby to system 10 alerted to attempted entry through the unlocked door, but a would-be burglar may be deterred thereby.

It will be noted that in system 10 as described, when door 13 is locked, switch 22 is disconnected from battery 20. Therefore, use of door latch mechanism 44 will not result in an annunciator sound. However, manipulating knob 46 may, if door 12 is thereby rattled, cause initiation of an alarm sound. Thus, whether locked or unlocked, system 10 may deter a would-be burglar who is testing for unlocked doors.

Turning now to FIG. 2, there is shown in simplified diagrammatic form two part lock-set 12 including system 10 to provide a self-contained combination lock set and alarm/annunciator system contained within a single housing 52. A printed circuit board 54 is secured within housing 52 such as by a plastic housing or frame (not shown) to properly situate the electrical parts of system 10 and the mechanical parts of the lock-set. Mounted to circuit board 54 are the electronics of system 10 including the amplifier (not shown) of speaker system 36. Switches 14 and 22 (which are preferably micro-switches) may also be mounted to board 54 with the board positioned such that cam extensions 56 and 58 of mechanisms 16 and 44, respectively, operate switches 14 and 22 as will be described. LED 32 is mounted to sit behind front wall 72 of housing 52 so as to be seen through an aperture in wall 72 and from a position exterior of the door (see FIG. 4). A lens (not shown) may be mounted on wall 72 in the aperture overlying LED 32. Similarly, speaker 36, of speaker system 36 is preferably mounted within housing 52 which is vented in the back as at 59 to allow the speaker sounds to emanate out of housing 52 and to alert those inside as well to alert others in the vicinity and to scare off the burglar. Although not shown, it will be readily appreciated that an accessway through the back wall of housing 52 may be provided to allow replacement of battery 20 as needed.

To mount the self-contained system of FIG. 2 to a door 13, some minor modifications to the door may be necessary. To this end, as seen in FIG. 3, a typical door 13 may include a pair of predrilled apertures 60, 62 for separate dead-bolt and door latch mechanisms, respectively. To install the self-contained system, the area 64 between apertures 60 and 62 is removed (as shown by the dotted lines in FIG. 3) to open a single larger aperture within which lock-set 12 with alarm annunciator system 10 may be placed and secured (such as by screws or the like) to door 13 as shown in FIG. 4.

When installed in door 13 as shown in FIG. 4, dead-bolt mechanism 16 may be rotated to project the dead-bolt 18 out of or retract back into the edge 66 of the door, to lock and unlock door 13. Similarly, door knob 46 may be rotated to withdraw the door latch 45 into the door edge 66, the latch being normally biased outwardly to hold the door closed in door frame 70.

In operation, when dead-bolt mechanism 16 is actuated (such as with a key from outside the door) to extend dead-bolt 18 into door frame 70 and lock door 13 closed, cam extension 56 rotates into the position shown in FIG. 2 causing switch 14 to be in its second position thereby energizing alarm circuit 28. With alarm circuit 28 energized, electric circuit 30 is in the alarm mode, and the system is armed to provide an alarm sound when sensor 34 detects vibration of the door. As circuit 28 is energized, a circuit (not shown) may test battery 20 and if it is sufficiently charged, a brief beep or similar tone may be generated and coupled to speaker system 36 to indicate that the system is armed. Also, LED 32, mounted to be seen from the exterior of front wall 72 of housing 50 will flash on and off.

Alternatively, when dead-bolt mechanism 16 is actuated to withdraw bolt 18 from door frame 70, cam extension 56 rotates away from switch 14 allowing switch 14 to return to its first position such that electric circuit 30 is in the annunciator mode and both alarm circuit 28 and flasher circuit 26 are disabled. At that time, battery 20 will be coupled to switch 22. Rotation of door knob 46 to withdraw latch 45 from door frame 70 and allow door 13 to be opened simultaneously causes cam extension 58 to rotate away from switch 22. As a result, switch 22 is placed into its second position and allows power from battery 20 to be supplied (the door-open signal) to annunciator circuit 40 whereupon a chime sound will be emitted from speaker system 36. When released, the door knob 46 will return to its normal position with latch 45 extended and cam extension against switch 22 to return switch 22 to its first position.

Figure 5:
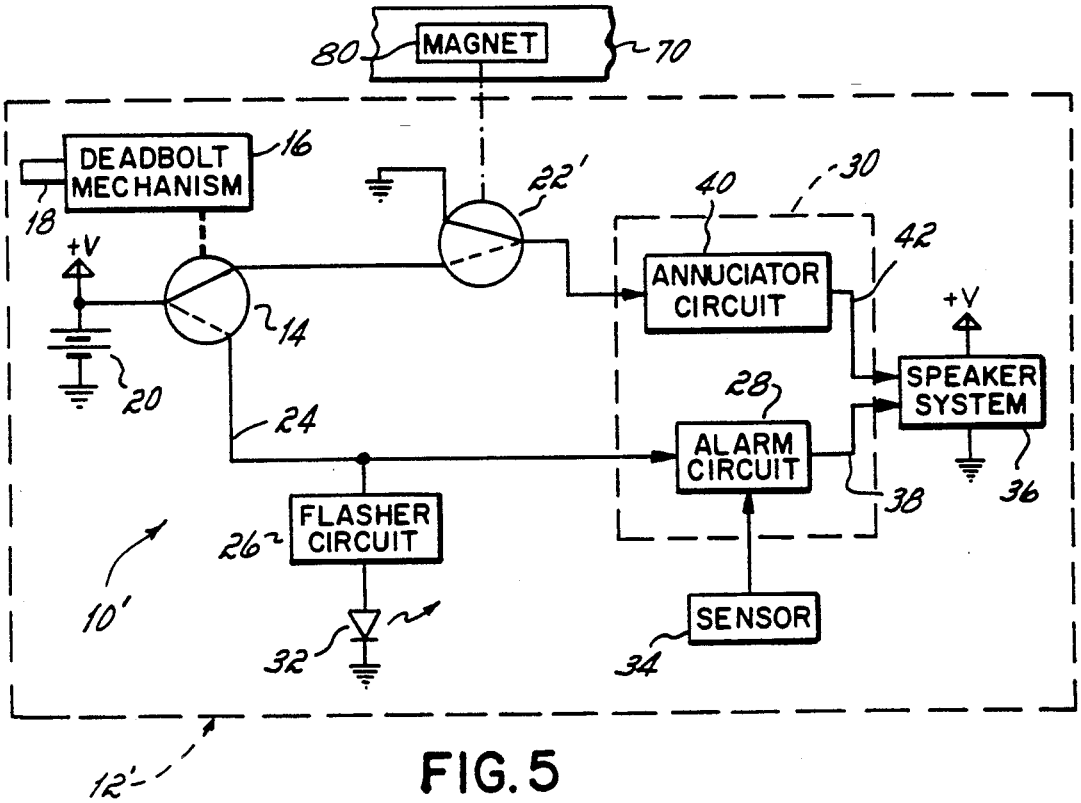
FIG. 5 is an electrical circuit block diagram of an embodiment of a dead-bolt-only lock set embodiment of an alarm/annunciator system in accordance with the principles of the present invention.

In accordance with a further feature of the present invention, the alarm/annunciator circuit may be modified slightly (embodiment 10') for a dead-bolt only lock-set 12'. To this end, and as shown in FIG. 5, there is no door latch mechanism to operate annunciator circuit 40. Instead, switch 22 of embodiment 10 is replaced with a reed relay switch 22', for example, which is normally in the closed position (dashed line) unless actuated such as by a magnet 80 mounted in doorframe 70 which causes switch 22 to switch to the opened position (solid line).

Figure 6:
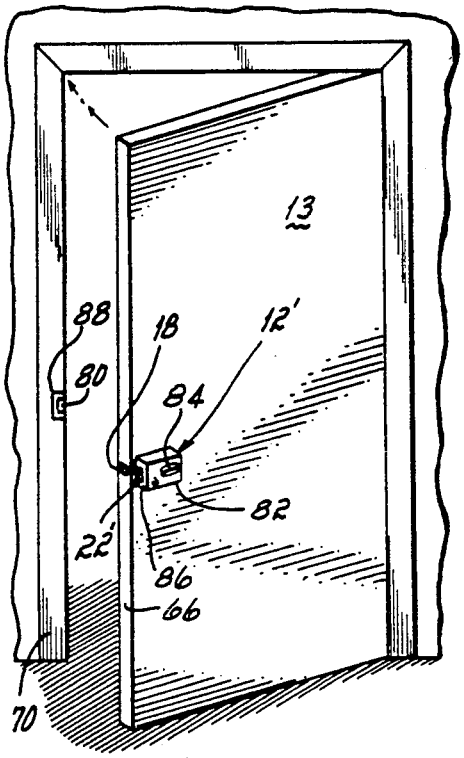
FIG. 6 is a perspective view of an open door and frame showing the self-contained alarm/annunciator of FIG. 5 installed therein.
Figure 7A:
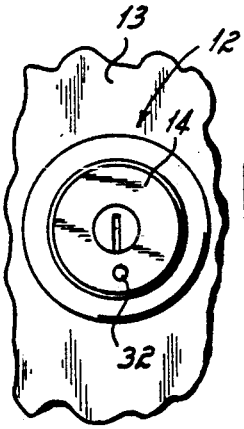
FIGS. 7A, 7B, and 7C are front, side, and rear views, respectively of the self-contained alarm/ annunciator of FIG. 5.
Figure 7B:
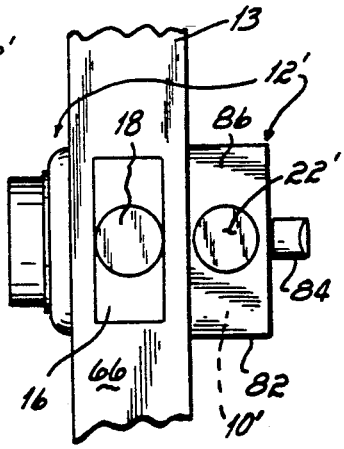
Figure 7C:
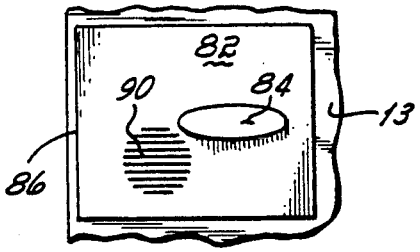

With reference to FIG. 6, lock set 12' is mounted to aperture 60 of door 13 (see FIG. 3) such that dead-bolt 18 extends through edge 66 of door 13 with the electronics of system 10' contained within housing 82 with dead-bolt actuating knob 84 extending out the rear of housing 82. Note that for ease of utilizing FIG. 6, neither aperture 62 of door 13 nor latch mechanism 44 are shown, although it will be appreciated that door 13 in FIG. 6 might normally have such a latch mechanism separate and apart from dead-bolt only lock-set 12'. Similarly, an accessway (not shown) may be provided on the top of housing 82 for access to the battery. Housing 82 is positioned on door 13 with reed switch 22' situated alongside edge wall 86 of housing 82 (see FIG. 7B). Magnet 80 is positioned on door frame 70, such as in recess 88 formed thereon, so as to be adjacent reed switch 22' when door 13 is closed into door frame 70. Referring also to FIGS. 7A and 7C, LED 32 is mounted so as to be visible from the front of lock set 12, as seen in FIG. 7A while the back of housing 82 is apertured as at 90 (see FIG. 7C) to permit sounds from speaker system 36 to more readily emanate out of the unit.

In operation of the dead-bolt only system, the door is locked and unlocked, and the alarm enabled and disabled, respectively, as described previously in connection with the two part lock-set. The difference here is with respect to how the annunciator circuit is activated when the door is unlocked. To this end, when door 13 is closed into door frame 70, magnet 80 is adjacent reed switch 22' causing the switch to be in the solid line position shown in FIG. 5. As door 13 is opened, switch 22' and magnet 80 are separated thereby allowing switch 22' to return to the dotted line position thereby activating annunciator circuit 40 as previously described.

Additional circuitry may be provided for eliminating false alarms and for conserving the power of battery 20. Such circuitry, which will be briefly described herein, is available in the previously mentioned Excluder Plus door alarm system. For example, motion sensitive alarm systems may often be plagued by annoying false alarms triggered by authorized activity which nonetheless results in motion of the door. Therefore, various timers may be provided to eliminate such false alarms as will now be described by reference to alarm/annunciator system 100 shown in FIG. 8. System 100 is similar in operation to system 10 but further includes timer circuits 102, 104 and 106 with electrical circuit 30 to significantly reduce false alarms and conserve battery power as will now be described.

More specifically, as provided in the previously mentioned Excluder Plus door alarm, electric circuit 30 includes an arming timer circuit 102 coupled between line 24 and alarm circuit 28 to prevent circuit 28 from responding to an alarm state signal from sensor 34 for a predetermined period of time after switch 14 is first switched from the door unlocked to the door locked position. Normally, as previously described with respect to system 10, when alarm circuit 28 receives an alarm state signal from sensor 34 while in the alarm mode (door locked), alarm circuit 28 promptly transmits an alarm-on signal to speaker system 36 such that an alarm is sounded. With the addition of arming timer 102, however, when door 13 is initially locked, alarm circuit 28 is not responsive to any alarm state signals from sensor 34 for a predetermined period of time, such as 90 seconds. As a result of this initial delay period, arming timer 102 allows locking of door 13, withdrawal of the key (not shown) from dead-bolt mechanism 16, and the settling of other disturbances on door 13 such as may be due to hits on the door or door frame 70 by the departing person or slamming of a screen door (both not shown) without alarm circuit 28 generating the corresponding alarm sound normally resulting from such activity about door 13. As a consequence, false alarms from authorized exit and alarm system arming activity are minimized. Thereafter, after the delay period of arming timer 102, alarm circuit 28 will respond to alarm-on signals whenever entry through locked door 13 is attempted such that the motion of door 13 is sufficient to cause an alarm state signal from sensor 34.

In order to similarly reduce false alarms which may occur when an authorized entry is attempted by the homeowner, such as when a key is inserted to unlock the door, system 100 is provided with low volume timer network 104. Network 104 causes the alarm sound to initially be emitted from speaker system 36 at a relatively low volume (e.g., about 80–85 db) followed by a loud, full volume alarm sound (e.g., about 130 db). Low volume timer network 104, coupled between alarm circuit 28 and speaker system 36, temporarily and initially causes attenuation of the alarm-on signal coupled to speaker system 36, which in turn results in speaker system 36 initially emitting a corresponding low volume alarm sound during which a would-be burglar may be scared off and, if entry is authorized, time is provided to terminate the alarm before the loud alarm is sounded. When the delay period of low volume timer 104 has timed out, such as after 2 seconds, if door 13 is still locked (electric circuit 30 is still in the alarm mode), attenuation of the alarm-on signal is removed so that the full strength of that signal is coupled to speaker system 36. Consequently, the low volume initial alert sound is followed by the full, high volume alarm sound from speaker system 36. In this way, an initial low volume alarm sound allows the homeowner time to unlock the door and disarm system 100 before the loud alarm begins, thus minimizing the likelihood that a lawful entry into the house will disturb any neighbors or other house occupants. If electric circuit 30 is not placed into the annunciator mode during the delay period of timer 104, the alarm sound graduates to a high volume alarm to warn that a burglar is trying to gain access to the premises.

Alarm/annunciator system 100, as in the case of systems 10 and 10', is preferably self-contained as part of a lock-set and including a self-contained power source, such as a battery 20, within the housing. However, with such a power source, continuity of the alarm sound may result in a substantial drain of power which, if unchecked, would lead to a substantially shortened operating life for battery 20. To reduce power consumption and to prolong the life of battery 20, alarm timer 106 is provided. Alarm timer 106 is contained within electronic circuitry 30 and is coupled to alarm circuit 28 such that when an alarm-on signal is initially generated by alarm circuit 28, alarm timer 106 initiates a timer period such as 90 seconds. After the delay period of timer 106 times out, alarm circuit 28 is reset to terminate the alarm-on signal (and, hence, the alarm sound) thereby conserving battery power. Circuit 28 is then ready to receive subsequent alarm state signals from sensor 34 and to re-initiate the alarm sounding sequence described above.

Figure 8:
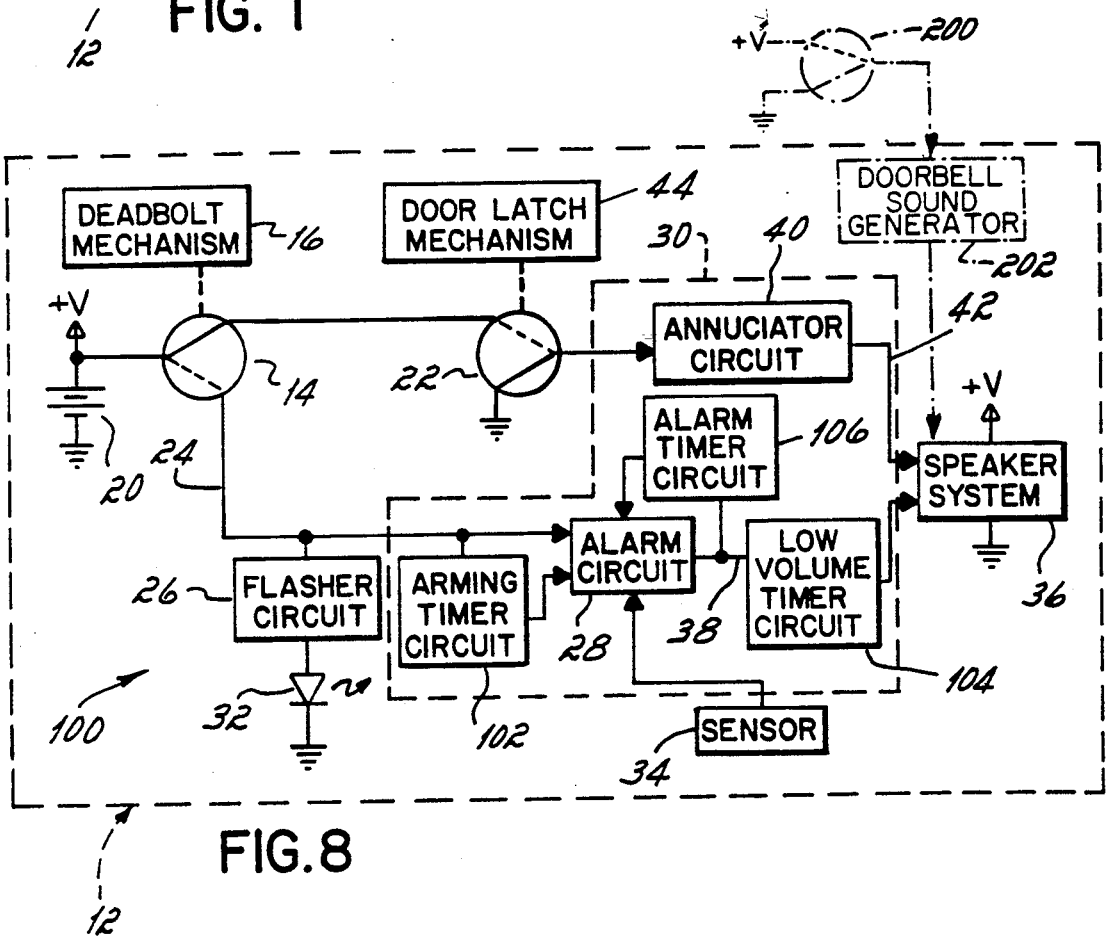
FIG. 8 is an electrical circuit block diagram of an alternative embodiment of an alarm/annunciator system in accordance with the principles of the present invention.

With minor modification, the embodiment of FIG. 8 could be adapted for the dead-bolt only version discussed in connection with FIGS. 5–7 above.

While the present invention has been illustrated by the description of alternative embodiments, and while the embodiments have been described in some detail, it is not the intention of applicants to restrict or in any way limit the scope of the appended claims to such detail. Additional advantages and modifications will readily appear to those skilled in the art. For example, the function of systems 10, 10', or 100 could be partially or completely replaced with an appropriately programmed microprocessor. Further functions could be added to the self-contained system such as a doorbell by adding a switch 200 (shown in phantom in FIG. 8) to wall 72 of housing 52 which energizes a doorbell sound generator 202, the output of which is also coupled to speaker system 36 to emit a doorbell sound. Further, while switches are shown for enabling and disabling the alarm mode and energizing the annunciator, other structure including position detectors or light detectors could be used. The invention in its broader aspects is therefore not limited to the specific details, representative apparatus and method and illustrative examples shown and described. Accordingly, departures may be made from such details without departing from the scope or spirit of applicants, general inventive concept.

What is claimed is:

1. A self-contained alarm/annunciator system for a door comprising, within a housing:

a dead-bolt mechanism with a dead-bolt adapted to be extended and retracted to lock and unlock the door;

a door latch mechanism with a latch for opening the door when retracted;

means associated with the dead-bolt mechanism for providing an alarm enable signal when the dead-bolt is extended such as to lock the door;

means associated with the door latch mechanism for providing a door opening signal when the door latch is retracted such as to open the door;

sensor means for providing an alarm state signal in response to motion of the housing whereby to sense attempted entry through the door;

electric circuit means being in an alarm mode in response to the alarm enable signal and being in an annunciator mode in the absence of the alarm enable signal, the electric circuit means operable in the alarm mode for providing an alarm-on signal in response to the alarm state signal and operable in the annunciator mode for providing an annunciator-on signal in response to the door opening signal;

means for providing a source of power to the electric circuit means;

speaker means responsive to the electric circuit means for providing an audible alarm sound in response to the alarm-on signal and an audible annunciator sound in response to the annunciator-on signal whereby to provide an alarm sound in response to motion of the locked door such as from attempted entry therethrough and an annunciator sound in response to attempted opening of the unlocked door.

2. The system of claim 1, further comprising:

a light source mounted to the housing to be visible from exterior the door; and means responsive to the alarm enable signal for energizing the light source.

3. The system of claim 2 further comprising flasher means responsive to the alarm enable signal for intermittently energizing the light source.

4. The system of claim 1, the means associated with the dead-bolt mechanism including a switch.

5. The system of claim 1, the means associated with the latch mechanism including a switch.

6. The system of claim further comprising:

doorbell sound generator means coupled to the speaker means for causing a doorbell sound to be emitted when the doorbell sound generator means is energized; and doorbell switch means mounted to the housing to be accessible from exterior the door for selectively energizing the doorbell sound generator means.

7. The system of claim 1 further comprising a battery connected to the power source providing means.

8. In combination, a door to be mounted to a frame and the system of claim 1, the door including a large face surface and an adjacent door edge surface, the system being contained in an aperture in the face surface with the dead-bolt and latch extending through corresponding apertures in the door edge surface for locking and securing the door closed in the frame.

9. A self-contained alarm/annunciator system for a door comprising, within a housing:

a dead-bolt mechanism with a dead-bolt adapted to be extended and retracted to lock and unlock the door;

means associated with the dead-bolt mechanism for providing an alarm enable signal when the dead-bolt is extended such as to lock the door;

sensor means for providing an alarm state signal in response to motion of the housing whereby to sense attempted entry through the door;

electric circuit means being in an alarm mode in response to the alarm enable signal for providing, in the alarm mode, an alarm-on signal in response to the alarm state signal;

means for providing a source of power to the electric circuit means;

speaker means responsive to the electric circuit means for providing an audible alarm sound in response to the alarm-on signal;

a light source mounted to the housing to be visible from exterior the door; and flasher means responsive to the alarm enable signal for intermittently energizing the light source whereby to provide a flashing light deterrence when the door is locked.

10. The system of claim 9, the means associated with the dead-bolt mechanism including a switch.

11. The system of claim 9 further comprising:

means for providing a door opening signal when the door is opened, the electric circuit means being in an annunciator mode in the absence of the alarm enable signal for providing, in the annunciator mode, an annunciator-on signal in response to the door opening signal, the speaker means further being responsive to the electric circuit means whereby to provide an audible annunciator sound in response to opening of the door.

12. The system of claim 11, the door opening signal-providing-means including a reed switch being responsive to a magnet placed adjacent thereto.

13. In combination, a door to be mounted to a frame and the system of claim 12, the door including a large face surface and an adjacent door edge surface, the system being contained in an aperture in the face surface with the dead-bolt extending through a corresponding aperture in the door edge surface for locking and securing the door closed in the frame, and magnet means to be placed in a recess in the frame adjacent the aperture in the door edge surface for activating the reed switch to provide the door opening signal when the reed switch is moved away from the magnet as the door is opened.

14. The system of claim 9 further comprising:

doorbell sound generator means coupled to the speaker means for causing a doorbell sound to be emitted when the doorbell sound generator means is energized; and doorbell switch means mounted to the housing to be accessible from exterior the door for selectively energizing the doorbell sound generator means.

15. In a door having a dead-bolt adapted to be extended and retracted by a dead-bolt mechanism to lock and unlock the door and a door latch for opening the door when retracted an alarm and annunciator method comprising:

providing an alarm enable signal when the dead-bolt is extended to lock the door;

providing a door opening signal when the door latch is retracted to open the door;

providing an alarm state signal in response to motion of the door;

emitting an audible alarm sound in response to provision of both the alarm enable and alarm state signals;

emitting an audible annunciator sound in response to provision of the door opening signal in the absence of the alarm enable signal, whereby to provide an alarm sound in response to motion of the locked door such as from attempted entry therethrough and an annunciator sound in response to attempted opening of the unlocked door.

16. The method of claim 15, further comprising emitting a visible light exteriorly the door in response to the alarm enable signal.

17. The method of claim 15, further comprising intermittently emitting a visible light exteriorly the door in response to the alarm enable signal.

18. In a door having a dead-bolt adapted to be extended and retracted by a dead-bolt mechanism to lock and unlock the door, an alarm and annunciator method comprising:

providing an alarm enable signal when the dead-bolt is extended to lock the door;

providing an alarm state signal in response to motion of the door;

emitting an audible alarm sound in response to provision of both the alarm enable and alarm state signals;

intermittently emitting a visible light exteriorly the door in response to the alarm enable signal.

19. The method of claim 18 further comprising providing an annunciator signal in response to opening of the door and emitting an audible annunciator sound in response the annunciator signal and the absence of the alarm enable signal.

* * * * *

UNITED STATES PATENT AND TRADEMARK OFFICE

CERTIFICATE OF CORRECTION

PATENT NO. : 5,311,168

DATED : May 10, 1994

INVENTOR(S) : David H. Pease, Jr. et al

It is certified that error appears in the above-identified patent and that said Letters Patent is hereby corrected as shown below:

Column 3, line 46, "Which" should read --which--.

Column 4, line 58, the first occurrence of "36" should read --36'--.

Column 6, line 8, "12," should read --12'--.

Column 8, line 14, "applicants," should read --applicants'--.

Column 8, line 64 "claim" should --claim 1--.

Signed and Sealed this

Eighteenth Day of April, 1995

Bruce Lehman

*Attest:*

BRUCE LEHMAN

*Attesting Officer*

*Commissioner of Patents and Trademarks*